United States Patent [19]

Kohama et al.

[11] 4,230,079

[45] Oct. 28, 1980

[54] EXHAUST GAS RECIRCULATION SYSTEM FOR INTERNAL COMBUSTION ENGINES

[75] Inventors: Tokio Kohama; Tadashi Ozaki, both of Nishio; Hideki Obayashi, Aichi; Hidetaka Nohira, Mishima, all of Japan

[73] Assignees: Nippon Soken, Inc., Nishio; Toyota Jidosha Kogyo Kabushiki Kaisha, Tokyo, both of Japan

[21] Appl. No.: 17,147

[22] Filed: Mar. 2, 1979

[30] Foreign Application Priority Data

Mar. 3, 1978 [JP] Japan ..... 53-24849

[51] Int. Cl.[3] ..... F02M 25/06

[52] U.S. Cl. ..... 23/568

[58] Field of Search ..... 123/119 A

[56] References Cited

U.S. PATENT DOCUMENTS

| | | | |
|---|---|---|---|
| 4,109,624 | 8/1978 | Washio et al. | 123/119 A |
| 4,128,089 | 12/1978 | Tarimoto et al. | 123/119 A |
| 4,137,874 | 2/1979 | Otsubu et al. | 123/119 A |

*Primary Examiner*—Wendell E. Burns

*Attorney, Agent, or Firm*—Cushman, Darby & Cushman

[57] ABSTRACT

An exhaust gas recirculation system for internal combustion engines comprises an exhaust gas recirculating passage for tapping engine exhaust gas from an exhaust pipe and feeding back to an engine intake pipe downstream of a throttle valve disposed therein, a control valve for opening and closing the recirculating passage in response to a pressure signal, and a throttle port formed in the intake pipe at such position that the port lies upstream of the throttle valve at the fully closed position thereof while lying downstream of the throttle valve when it is opened to a predetermined opening angle. A pressure control valve is provided for controlling the pressure signal to be transmitted to the control valve in accordance with a pressure in the intake pipe downstream of the throttle valve, a pressure derived from the throttle port and a pressure in a pressure cell provided in the recirculating passage upstream of the control valve, thereby to control the exhaust gas recirculation rate fed back to the intake pipe in consideration of the operating load conditions and the revolution number of the engine.

7 Claims, 17 Drawing Figures

EXHAUST GAS RECIRCULATION SYSTEM FOR INTERNAL COMBUSTION ENGINES

BACKGROUND OF THE INVENTION

1. Field of the Invention

The present invention relates to an engine exhaust gas recirculation system effective to reduce the emission of nitrogen oxide ($NO_x$) from an exhaust system of an internal combustion engine.

2. Description of the Prior Art

There has been hitherto known an exhaust gas recirculation system (hereinafter referred to also as E.G.R. system in abridgement) for internal combustion engines which comprises an exhaust gas recirculating passage for tapping the engine exhaust gas from an exhaust pipe of the engine and feeding back to an intake pipe thereof at a location downstream of a throttle valve, a flow control valve provided in the recirculating passage for controlling the flow of the exhaust gas fed back to the intake pipe in response to a pressure signal derived from the engine intake pressure in the intake pipe, and a pressure control valve apparatus for correctively controlling the pressure signal to be transmitted to the flow control valve as a function of the pressure in a pressure cell which is provided in the recirculating passage between the exhaust gas pipe and the flow control valve.

With the arrangement of the hitherto known E.G.R. system outlined above and described hereinafter in detail, the quantity of the so-called external exhaust gas recirculation which is caused to flow back to the intake pipe from the exhaust pipe through the recirculating passage can be maintained at a predetermined ratio with respect to the quantity of engine intake air. However, with the prior art E.G.R. system, it has been impossible to control the quantity of the recirculated exhaust gas in consideration of the operating load conditions of the associated internal combustion engine.

SUMMARY OF THE INVENTION

Accordingly, an object of the invention is to provide an exhaust gas recirculation system for internal combustion engines which is capable of controlling the quantity of the recirculated exhaust gas in a desirable manner in consideration of the operating load conditions of the engine.

Another object of the invention is to provide an exhaust gas recirculation system for an internal combustion engine which is capable of recirculating an ideal quantity of the exhaust gas to the intake pipe of the engine in a medial or intermediate load condition as well as in a light load condition of the engine, while decreasing reasonably the quantity of the exhaust gas recirculation in a heavy load operating condition of the engine, thereby to assure a remarkable reduction in fuel consumption while assuring an increased output power of the engine.

In view of the above and other objects which will become more apparent as description proceeds, it is proposed according to a general aspect of the invention that a throttle port is provided in the intake pipe at such a position that the throttle port lies upstream of the throttle valve at the fully closed position thereof but lies downstream of the throttle valve when it is opened to a predetermined opening degree or angular position in a predetermined range, and that the pressure control valve apparatus includes a pressure control unit for controlling the pressure signal in dependence on both the throttle negative pressure produced in the throttle port and the pressure produced in the pressure cell, a load control unit for controlling the throttle negative pressure applied to the pressure control units by introducing thereto an amount of ambient air in dependence on the intake negative pressure produced in the engine intake pipe downstream of the throttle valve, and a bypass passage for constantly communicating the chamber of the load control unit into which ambient air is introduced with a chamber of the pressure control unit to which the throttle negative pressure at the throttle port is applied.

Above and other objects, novel features and advantages of the invention will be better understood from the following description of preferred embodiments thereof taken in conjunction with the accompanying drawings.

BRIEF DESCRIPTION OF THE DRAWINGS

FIGS. 14 and 15 shows schematically arrangements of E.G.R. system according to further embodiments of the invention.

Same or similar reference numerals are used to designate same or similar parts throughout the figures.

DETAILED DESCRIPTION OF THE PREFERRED EMBODIMENTS

Before entering into description of the exemplary embodiments of the invention, a typical one of the hitherto known E.G.R. systems for internal combustion engine will be first described in order to have a better understanding of the invention.

Figure 1:
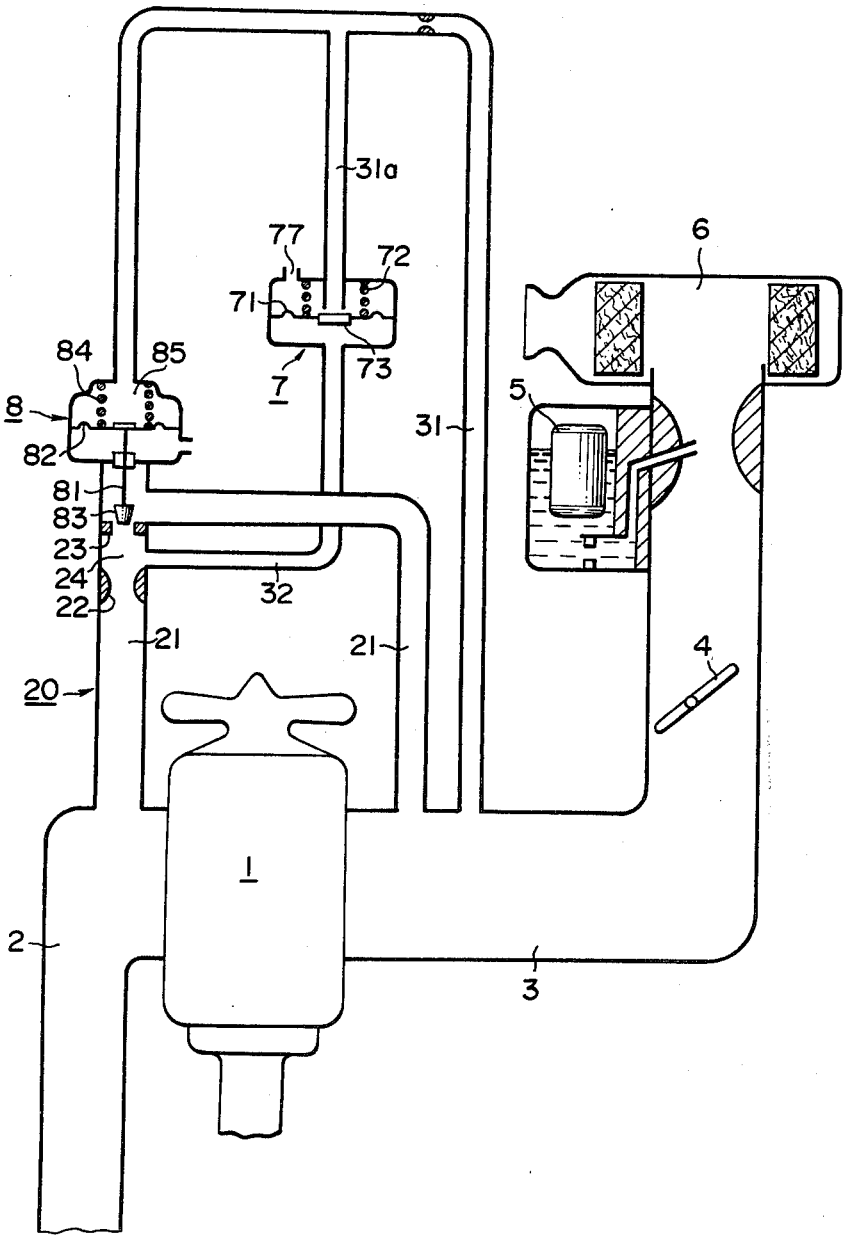
FIG. 1 PRIOR ART
FIG. 1 shows schematically an arrangement of a hitherto known E.G.R. system for an internal combustion engine, FIG. 2 graphically shows relationships between external exhaust gas recirculation (E.G.R.) ratio and intake negative pressure in an intake pipe of the engine to illustrate the principle of the invention, FIG. 3 graphically shows desirable E.G.R. ratio characteristics as a function of the intake negative pressure, FIG. 4 graphically shows relationships between the throttle negative pressure and the intake negative pressure with engine revolution number being used as parameter.

Referring to FIG. 1 which shows schematically a general arrangement of a prior art exhaust gas recirculation or E.G.R. system, the quantity of engine intake air determined in dependence on the angular position or opening degree of a throttle valve 4 is mixed with a fuel such as gasoline in a carburetor 5. The fuel-air mixture thus produced undergoes combustion within the engine cylinders 1 and the resulting combustion products are emitted through the exhaust pipe 2 as the engine exhaust gas to the atmosphere. At that time, an exhaust gas pressure $P_{Ex}$ is produced in the exhaust gas pipe 2 as a function of the quantity of the engine exhaust gas which is approximately proportional to the quantity of intake air. The E.G.R. system indicated generally by the reference numeral 20 includes a recirculating passage 21 in which a restriction 22 of a fluid-flow cross-sectional area A is provided and is adapted to form a pressure cell 24 in corporation with a valve seat 23. The pressure produced in the pressure cell 24 is fed to a pressure control valve apparatus or a modulator 7 through a pressure conduit 32. Reference numeral 8 designates generally a control valve having a valve element 83 which is resiliently urged toward the valve seat 23 by a spring 84. Reference numeral 6 denotes an air cleaner.

The exhaust gas pressure $P_{Ex}$ produced in the exhaust gas pipe 2 is applied to the pressure cell 24 and hence, through the pressure conduit 32, to the modulator 7, as the result of which a partition diaphragm 71 constituting a part of the modulator 7 is caused to move upwardly as viewed in FIG. 1 against the force of a spring 72. Consequently, a valve element 73 mounted on the diaphragm 71 is caused to close an open end of a branch conduit 31*a* branched from a pressure conduit 31, resulting in a decreased ambient air flow into the pressure conduit 31 through an inlet port 77 opened to the atmosphere and the branch conduit 31*a*. Under these conditions, the negative pressure prevailing in the intake pipe 3 is directly supplied to an upper chamber 85 of the control valve 8 without being reduced by the supply of atmospheric or ambient air. Due to the negative pressure, the diaphragm 82 is caused to move upwardly as viewed in FIG. 1 against the force of a spring 84, thereby to displace the valve element 83 away from the valve seat 23. It will be noted that the valve element 83 is connected to the diaphragm 82 through a connecting rod 81. The pressure in the pressure cell 24 will be then correspondingly decreased, giving rise to the downward movement of the diaphragm 71 of the modulator 7 under the force of the spring 72. The ambient air is thus allowed to flow into the pressure conduit 31 through the inlet port 77 and the branch conduit 31*a*, whereby the negative pressure applied to the control valve 8 is decreased. Consequently, the valve element 83 of the control valve 8 is moved in the direction to close the valve seat 23, thereby increasing the pressure in the pressure cell 24. In this manner, the pressure $P_e$ within the pressure cell 24 is maintained at a substantially constant level which is usually set at a value approximating to the atmospheric pressure. When the above-explained control is effected, the quantity or rate of exhaust gas recirculation $Q_{EGR}$ can be expressed by the following equation:

$$Q_{EGR}=CA\sqrt{P_{Ex}-P_e}\approx CA\sqrt{P_{Ex}}$$

where C represents a flow coefficient and A represents the cross-sectional flow area of the restriction 22. In other words, the quantity of the exhaust gas recirculation $Q_{EGR}$ can be made to be substantially proportional to the quantity of engine intake air since the exhaust gas pressure $P_{Ex}$ is substantially proportional to the latter, whereby the external E.G.R. ratio described hereinbefore can be maintained at a constant value, as is illustrated by a dotted broken curve A in FIG. 2.

It should however be mentioned in conjunction with the exhaust gas recirculation or E.G.R. system for practical applications that the residual combustion products remaining in the engine cylinders even after the scavenging process will equally affect the contents of $NO_x$ in the engine exhaust gas and thus have to be taken into consideration together with the external exhaust gas recirculation described above. In other words, in order to reduce effectively the contents of $NO_x$ in the engine exhaust gas, both of the external E.G.R. and the residual gas which may be referred to as internal E.G.R. for the convenience sake of description have to be simultaneously considered and correspondingly controlled.

It has been found that the ratio of the internal E.G.R. (i.e. the quantity of the residual gaseous combustion products remaining in the engine cylinder) to the quantity of engine intake air tends to decrease in a heavy load operating state of the engine in which the negative pressure in the intake conduit remains at a relatively low level and increase in a light load operating condition of the engine, as is illustrated by a solid line A in FIG. 3. Accordingly, the ratio of total quantity of E.G.R. (i.e. the sum of the external and the internal E.G.R.s) relative to the quantity of engine intake air will be decreased in a heavy load region of the engine, while being increased in the light load operating condition of the engine, as is represented by a single-dotted broken line B in FIG. 3. This in turn means that an attempt to attain an ideal quantity of E.G.R. in a medial load operating condition of the engine illustrated by a solid line C in FIG. 3 will encounter difficulty such that the total quantity of the recirculated exhaust gases will be increased excessively in the light engine load region, involving adverse influences to the operating condition of the engine.

Figure 2:
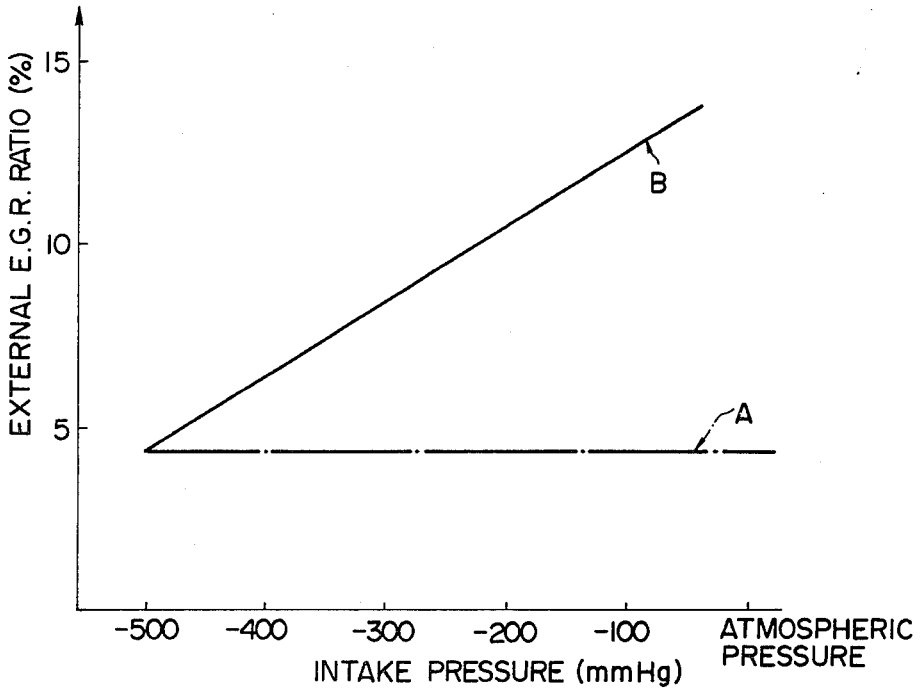
Figure 3:
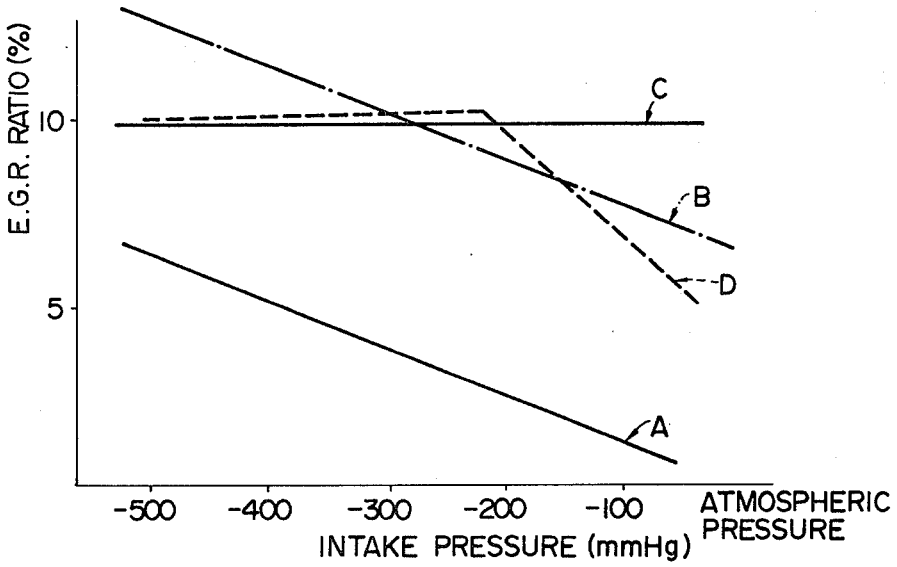

In the light of the technical state described above, the inventors of the present application have developed an exhaust gas recirculation or E.G.R. system which can be controlled in dependence on the engine loads such that the ratio of the external exhaust gas recirculation quantity to the engine intake air quantity is high in the heavy load operating condition of the engine and decreased in the light load engine operating condition as indicated by a solid line B in FIG. 2 with a view to attaining an ideal exhaust gas recirculation performance such that the ratio of the total quantity of E.G.R. defined above to the engine intake air quantity remains substantially constant throughout all the operating load regions of the engine as indicated by the solid line C in FIG. 3.

However, experimental examinations on the operations of internal combustion engines practically installed on motor cars have shown that the internal combustion engines are operated usually under the medial and light operating states in which the negative pressure in the engine intake passage falls within the range of about −200 mmHg to −400 mmHg, and that the heavy load engine operations hardly occur in which the negative pressure in the intake passage shows smaller value approximating the atmospheric pressure. Also, it has found that the heavy load operation of an engine installed on a motor car takes place, for instance, in the case of the suburban driving at high running speed of the motor car where a relatively high output of the engine is desired to assure a good maneuverability of the car.

In the course of developing the exhaust gas recirculation or E.G.R. system for an internal combustion engine as envisaged by the invention which is capable of supplying an ideal quantity of the recirculated exhaust gas in a medial and a light load operating conditions of the engine on one hand and decreasing reasonably the quantity of the recirculated exhaust gas in the heavy or high load operating condition of the engine on the other hand, as is indicated by a broken line D in FIG. 3, a fact to be remarked has been found that the negative pressure at a throttle port provided in a vicinity of the throttle valve in the manner described hereinafter is increased as the engine operating condition proceeds to the medial load operation range from the light load range, while the same pressure is decreased after the negative pressure in the engine intake pipe (hereinafter referred to also as the intake negative pressure) has attained a predetermined value. Further, it has been found that the peak value of the negative pressure at the throttle port will vary not only as function of the negative pressure in the engine intake pipe and the load conditions of the engine but also as a function of the position of the throttle port relative to the throttle valve. The present invention starts from these discovered facts.

Now, the invention will be described with reference to FIG. 6 which shows a general arrangement of the exhaust gas recirculation or E.G.R. system according to an embodiment of the invention. An internal combustion engine generally denoted by numeral 1 is provided with an exhaust conduit or pipe 2 and an intake pipe 3. A throttle valve 4 is provided in the intake pipe 3. A carburetor 5 for producing a fuel-air-mixture from a liquid fuel such as gasoline and air supplied through an air cleaner 6 is provided upstream of the throttle valve 4.

An exhaust gas recirculation system or E.G.R. system generally denoted by reference numeral 20 includes an exhaust gas recirculating passage 21 and a recirculation control valve 8. The recirculating passage 21 is communicated with the exhaust pipe 2 at one end and has the other end opened into the intake pipe 3 at a position downstream of the throttle valve 4. A fixed restriction 22 and a valve seat 23 are formed in the recirculating passage 21 in an intermediate portion between the control valve 8 and the exhaust pipe 2. The control valve 8 has a valve element 83 which forms a variable restriction in cooperation with the valve seat 23.

The flow control valve 8 comprises a housing 86 in which diaphragm chambers 85 and 87 are defined by a partition diaphragm 82. The first or upper chamber 85 defined by the inner wall of the housing 86 and the upper surface of the diaphragm 82 is adapted to be applied with a pressure signal which is derived from the intake pipe 3 through a first pressure conduit 31 having an end opened in the intake pipe 3 downstream of the throttle valve 4 and which is controlled by a pressure control valve apparatus 7 in a manner described hereinafter. A negative intake pressure prevailing in the intake pipe 3 is utilized as the pressure source for the pressure signal mentioned above. The second or lower diaphragm chamber 87 defined by the lower surface of the diaphragm 82 and the lower half inner wall of the housing 86 is communicated to the atmosphere through an inlet port 88 formed in the housing 86. The valve element 83 described hereinbefore is connected to the diaphragm 82 through a connecting rod 81. A coil spring 84 is accommodated within the first diaphragm chamber 85 so as to resiliently urge the diaphragm 82 downwardly and hence the valve element 83 toward the valve seat 23.

Figure 7:
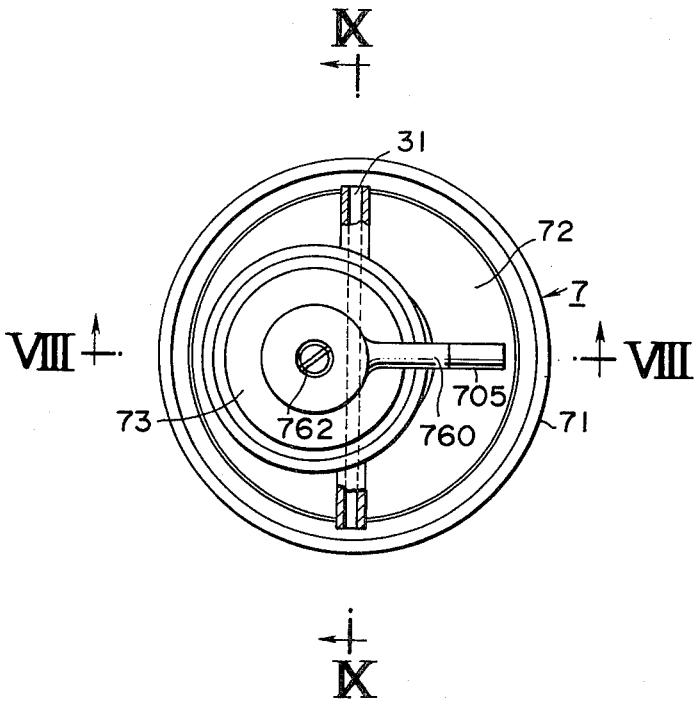
FIG. 7 is a top plan view of a pressure control valve apparatus employed in the E.G.R. system shown in FIG. 6.

Reference numeral 7 denotes generally the pressure control valve apparatus which is composed of two main parts, i.e. a pressure control unit 700 and a load control unit 750 and comprises first, second and third housing sections 71, 72 and 73 which may be made of a suitable material such as resin, iron, aluminium, copper or the like or alloys thereof. Structure of this pressure control valve apparatus is shown in more detail in FIGS. 7 to 9.

The pressure control unit 700 has two diaphragm chambers 702 and 703 partitioned by a diaphragm 701 which is fixedly secured along the peripheral edge portion thereof between the first and the second housing sections 71 and 72. The diaphragm chamber 702 (referred to also as the third diaphragm chamber) which is defined by the lower surface of the diaphragm 701 and the first housing section 71 is communicated to the pressure chamber or cell 24 through a second pressure conduit 32 so as to be applied with the pressure signal from the cell 24, while the fourth diaphragm chamber 703 defined by the upper surface of the diaphragms 701 and the inner wall of the second housing section 72 has a pressure inlet port 705 which is communicated through a third pressure conduit 33 to a throttle port **4*a* formed in the intake pipe 3 in the manner described hereinafter so as to receive a throttle negative pressure on which definition will also be made hereinafter. The fourth diaphragm chamber 703 is communicated to a fifth diaphragm chamber 752 of the load control unit 750**, as will be made apparent as description proceeds.

The second housing section 72 constitutes a part of the first pressure conduit 31, wherein a branch conduit **31*a* branched from the first pressure conduit 31 has a lower end opened into the fourth diaphragm chamber 703 immediately above a middle portion of the diaphragm 701. Thus, the pressure within the fourth diaphragm chamber 703 may bleed into the first pressure conduit 31 through the branch conduit 31*a* thereby to regulate the level of the pressure signal supplied to the control valve 8 in dependence on the pressure in the pressure cell 24 and the throttle port 4*a***.

Figure 8:
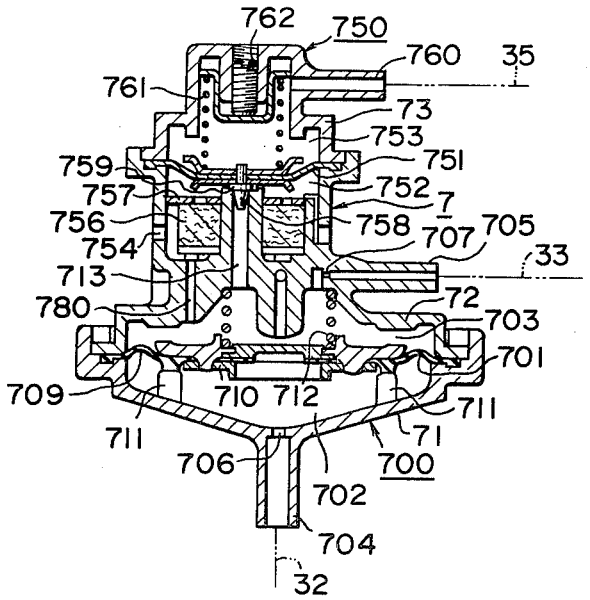
FIG. 8 is a vertical sectional view of the same taken along the line VIII—VIII in FIG. 7.
Figure 9:
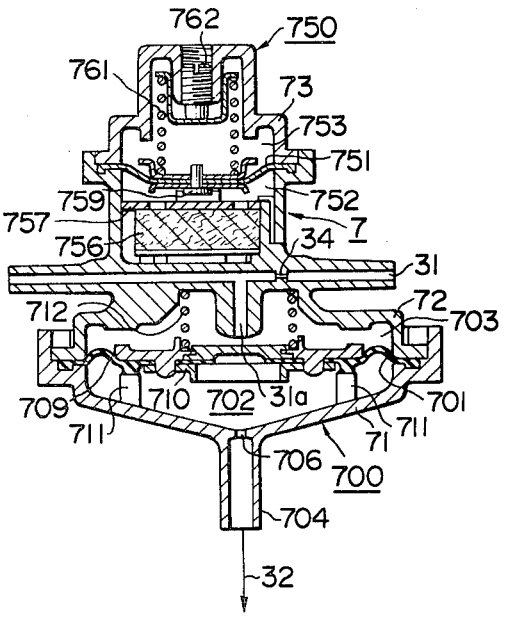
FIG. 9 is a vertical sectional view taken along the line IX—IX in FIG. 7, FIG. 10 graphically shows relationships between pressure in a fourth diaphragm chamber of a pressure control unit of the pressure control valve apparatus and the intake negative pressure with the engine revolution number being used as parameter, FIG. 11 graphically shows relationship between the throttle negative pressure and the intake negative pressure to illustrate the function of the bypass passage for communicating constantly the fourth diaphragm chamber with a fifth diaphragm chamber, FIG. 12 schematically shows an arrangement of an E.G.R. system which was manufactured for trial in the course of developing E.G.R. system accroding to the invention.

Particularly referring to FIGS. 8 and 9, a fixed restriction 706 is provided at a pressure inlet port 704 of the third diaphragm chamber 702, while a fixed restriction 707 is provided at the pressure inlet port 705 of the fourth diaphragm chamber 703. An upper plate 709 and a lower plate 710 are secured to the diaphragm 701 for assuring rigidity thereof. Reference numerals 711 deonte stopper members for limiting the displacement of the diaphragm 701. A coil spring 712 is provided in the fourth diaphragm chamber 703 and adapted to resiliently bias the diaphragm 701 downwardly as viewed in the drawing through the upper spring seat plate 709. Referring to FIG. 9, a fixed restriction 34 is formed in the first pressure conduit 31 at a position upstream of the branch conduit 31*a*.

Figure 4:
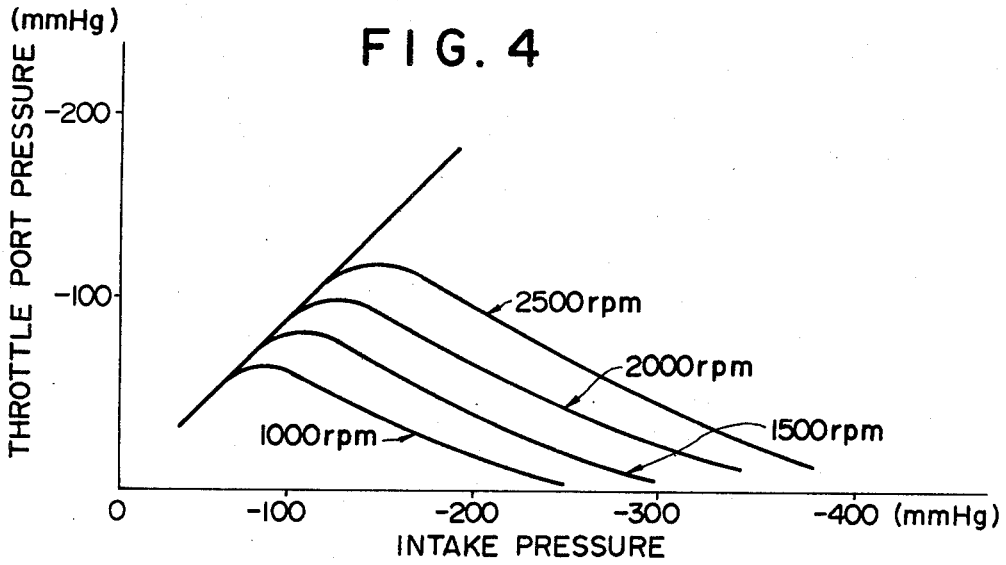
Figure 5A:
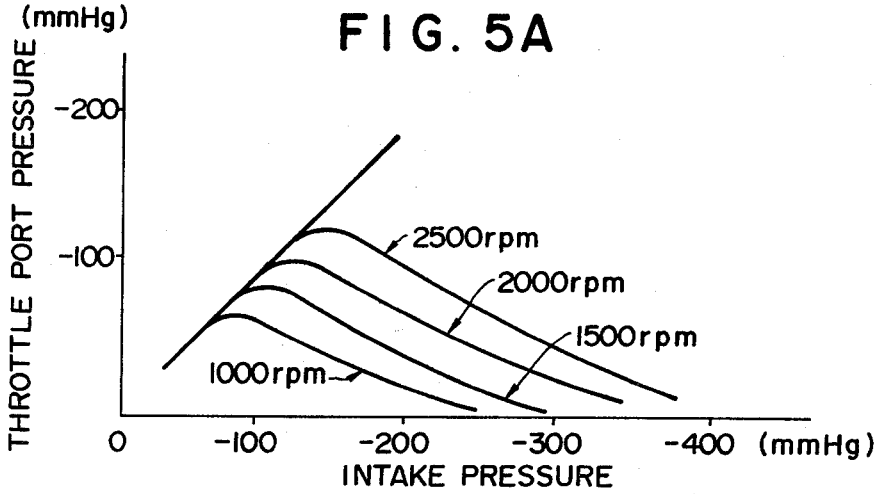
FIGS. 5A and 5B are similar views to FIG. 4 illustrating relationships between the throttle port negative pressure and the positions of the throttle port at which the throttle negative pressure is produced.
Figure 5B:
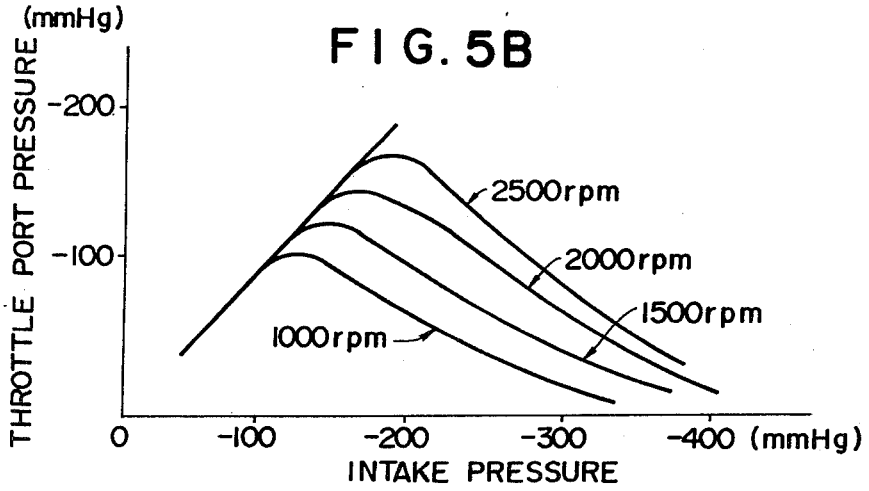
Figure 16:
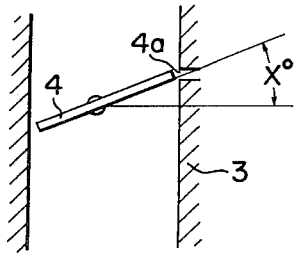
FIG. 16 illustrates schematically the positional relationship between the throttle valve and the throttle port provided according to the teaching of the invention.

Now, definition will be made on the terminology used herein. The throttle port 4*a* is a port communicated to the fourth diagram chamber 703 and formed in the intake pipe 3 at such position relative to the throttle valve 4 that the port 4*a* is located upstream of the throttle valve 4 at the fully closed position thereof but located at least partially downstream of the throttle valve 4 when the latter is opened to a predetermined opening degree or angle X° (see FIG. 16) with reference to a transversal plane extending through the center of the throttle valve shaft. Further, the term "throttle negative pressure" or simply "throttle pressure" means the pressure produced at the throttle port 4*a*. It has been experimentally found that the throttle negative pressure at the throttle port 4*a* becomes substantially equal to the atmospheric pressure when the throttle valve 4 is fully closed and varies in dependence on the intake negative pressure prevailing in the intake pipe 3 downstream of the throttle valve 4 and additionally as a function of the operating load conditions of the engine, as is graphically illustrated in FIG. 4. More specifically, the throttle negative pressure will increase as the revolution number of the engine is increased. For a given revolution number, the throttle negative pressure will increase as the intake negative pressure is increased, i.e. as the engine load condition proceeds from the light load region to the medial load region until a peak level has been attained, after which the throttle negative pressure will decrease as the intake negative pressure is increased. Besides, it has been found that the peak value of the throttle negative pressure for any given revolution number of the engine will vary in respect of the magnitude thereof and in relation to the intake negative pressure as a function of the position of the throttle port 4*a*. This is illustrated in FIGS. 5A and 5B, in which FIG. 5A illustrates the throttle negative pressure characteristics when the throttle port 4*a* is formed at a position corresponding to the opening degree of 13° (X=13°) of the throttle valve, while FIG. 5B applies to the case where the throttle port 4*a* is formed at a position corresponding to the opening degree of 11° (X=11°) of the throttle valve 4. In the case of the illustrated embodiment, the throttle port 4*a* is opened at a position falling within the range of the opening degrees or angles of the throttle valve 4 from 11° to 35° relative to the fully closed position of the throttle valve 4.

Referring again to FIGS. 6 to 9, the load control unit 750 includes two diaphragm chambers 752 and 753 defined by a diaphragm 751 secured fixedly along the peripheral portion between the second housing section 72 and the third housing section 73. The fifth diaphragm chamber 752 defined by the lower surace of the diaphragm 751 and the inner wall of the second housing section 72 is communicated to the atmosphere through a port 754 and to the fourth diaphragm chamber through a communication passage 713 opened in the fifth diaphragm chamber 752 in opposition to a middle portion of the diaphragm 751 so that the atmospheric pressure introduced into the fifth chamber 752 may be transmitted to the fourth chamber 703. In this conjunction, it will be noted that an air filter 756 is provided in the fifth diaphragm chamber 752 between the air inlet port 754 and the communication passage 713 in order to catch therein dusts or the like foreign matter contained in air supplied to the fourth diaphragm chamber 703. The air filter 756 is held stationarily in place by a perforated fixture plate 757. A valve element 758 is connected to the diaphragm 751 at a center portion thereof through a connecting rod 759 and constitutes a variable restriction in cooperation with the open end of the communication passage 713. Further, a bypass passage 780 of a reduced diameter as compared with that of the passage 713 is provided downstream of the air filter 752 to communicate constantly the fifth chamber 752 to the fourth chamber 703 (refer to FIG. 8). The function of the bypass passage 780 will be described in detail hereinafter.

The sixth diaphragm chamber 753 defined by the upper surface of the diaphragm 751 and the inner wall of the third housing section is provided with a pressure inlet port 760 communicated to a third pressure conduit 35 which in turn is connected to the first pressure conduit 31 upstream of the pressure control valve apparatus 7, whereby the intake negative pressure in the intake pipe 3 is introduced to the sixth diaphragm chamber 753 by way of the first and the fourth pressure conduits 31 and 35. A coil spring 761 is contained in the sixth diaphragm chamber 753 to resiliently urge the diaphragm 751 downwardly and hence the valve element 758 toward the communication passage 713. The force of this bias spring 761 can be adjusted by means of a pressure adjusting screw 762. In this conjunction, it should be mentioned that the force of the spring 761 is set at a magnitude corresponding to that of the intake negative pressure at which the throttle negative pressure attains a maximum or peak level, so that, when the intake negative pressure supplied to the sixth diaphragm chamber 753 through the inlet port 760 attains a pressure level within the range of −200 mmHg to −400 mmHg, the valve element 758 is displaced to open the communication passage 713 thereby to allow ambient air to flow therethrough into the fourth diaphragm chamber 703.

Figure 10:
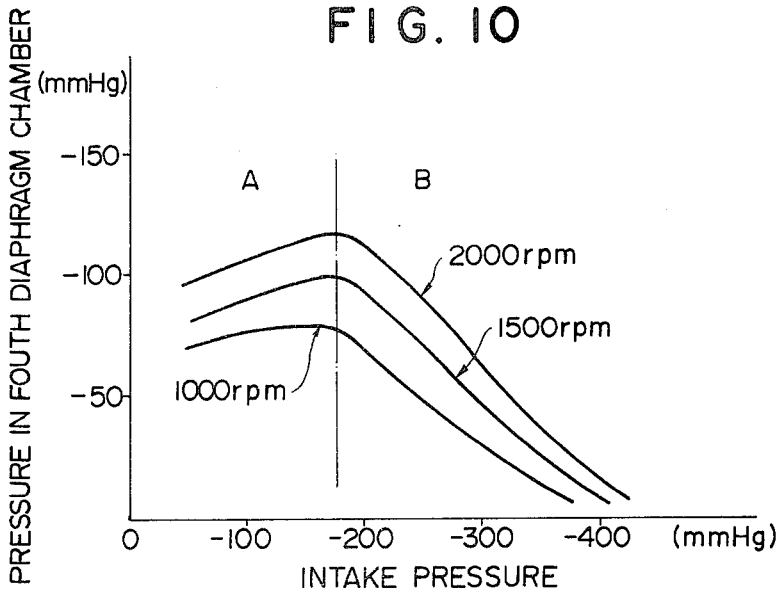

Next, description will be made on the operation of the E.G.R. system of the structure described above. In the operation of the internal combustion engine 1, the intake negative pressure, i.e. the negative pessure in the intake pipe 3 is applied to the sixth diaphragm chamber 753 of the load control unit 750 through the first and the fourth pressure conduits 31 and 35. Because the intake negative pressure is greater than the preset force of the spring 761 in the sixth diaphragm chamber 753 in the medial and light load operating conditions of the engine 1, the diaphragm 751 is caused to move upwardly as viewed in the drawing against the force of the spring 761, resulting in that the valve element 758 is displaced correspondingly to open the communication passage 713. Consequently, the flow cross-sectional area of the passage 713 controllable by the valve element 758 is controlled in dependence on the prevailing intake negative pressure in such manner that the former is increased as the latter increases and vice versa. Under the conditions, the quantity of air flow supplied to the fourth diaphragm chamber 703 from the atmosphere inlet port 754 through the air filter 756, the fifth diaphragm chamber 752 and the passage 713 is determined by the flow cross-sectional area of the communication passage 713. In this manner, the pressure within the fourth diaphragm chamber 703 remains at a relatively low level when the intake negative pressure is high, i.e. in the light load operating condition of engine and takes a high level when the negative pressure is low, i.e. in the heavy load operating condition of engine. Additionally, the negative pressure in the fourth diaphragm chamber 73 increases correspondingly as the revolution number of the engine is increased. These pressure characteristics of the fourth diaphragm chamber 703 are graphically illustrated in FIG. 10 at a right hand portion B. It will be thus appreciated that the pressure $P_e$ within the pressure cell 24 will become more negative, as the load of the engine becomes heavier and/or as the revolution number of the engine is increased. Thus, it will be understood from the equation $Q_{EGR}=CA\sqrt{P_{Ex}-P_e}$ mentioned hereinbefore that the quantity $Q_{EGR}$ of the exhaust gas recirculated to the intake pipe 3 through the recirculating passage 21 is increased as the load and/or revolution number of the engine 1 are/is increased, and the external E.G.R. ratio is high at a heavy load operating condition of the engine and vice versa. It should be remarked that the external E.G.R. ratio varies only in dependence on the engine load conditions and will not be influenced by variation in the engine revolution number, so that the ideal control such as illustrated by the solid curve B in FIG. 2 can be accomplished. More particularly, if the arrangement is constructed such that the pressure $P_e$ in the pressure chamber 24 varies only in dependence on the operating load conditions of engine, the pressure $P_e$ will remain constant independently from variation in the engine revolution number so far as the load on engine remains constant, while only the exhaust gas pressure $P_{EX}$ will be varied to cause variation in the external E.G.R. ratio even in the constant engine load condition. With the invention, it is envisaged that the external E.G.R. ratio be maintained substantially constant independently from variation in the revolution number of engine in the constant load state thereby to attain the ideal characteristic represented by the solid line curve C shown in FIG. 3. To this end, the exhaust gas recirculating system according to the invention is so arranged as to cause the pressure in the pressure cell 24 to be varied not only as a function of the load states of engine but also in dependence on variation in the number of revolution of the engine, as will be appreciated from the foregoing description.

When the intake negative pressure becomes smaller than the preset force of the spring 761 because of the engine operating state being shifted to the heavy load range, the fourth diaphragm chamber 703 receives only the throttle negative pressure through the third pressure conduit 33 and the atmospheric pressure by way of the bypass passage 780. Since the bypass passage 780 is of a reduced diameter as compared with that of the third pressure conduit 33, the pressure behavior in the fourth diaphragm chamber 703 is approximately proportional to the behavior of the throttle negative pressure. Further, due to the fact that the throttle port 4a is opened at such position that the throttle negative pressure becomes maximum at the intake negative pressure corresponding to the preset force of the spring 761, the throttle negative pressure will be decreased even when the engine load becomes heavier after the communication passage 713 has been closed. Under the conditions, the pressure in the fourth diaphragm chamber 703 takes behavoir such as represented by the characteristic curves shown at the left hand portion A in FIG. 10, resulting in that the external E.G.R. rate is decreased as the engine load is increased in contrast to the aforementioned case in which the engine is operated in the medial and the light load ranges.

Figure 11:
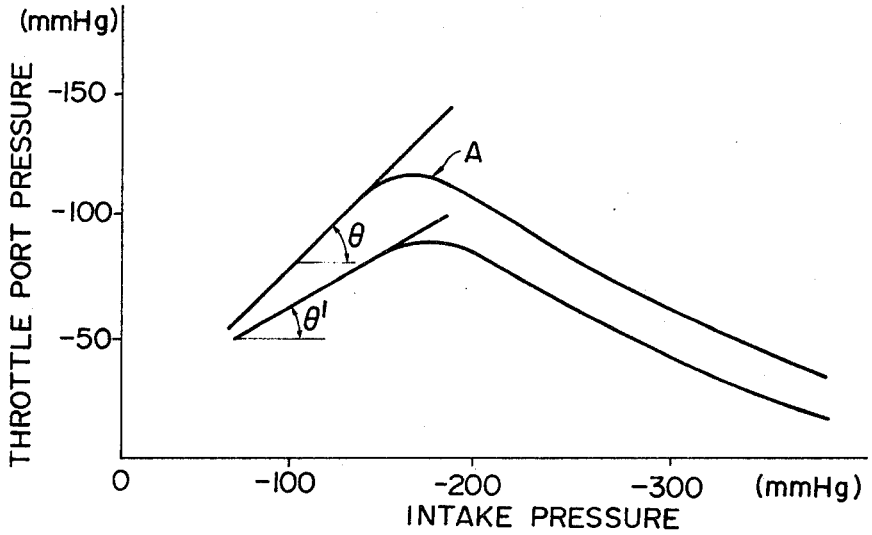
Figure 12:
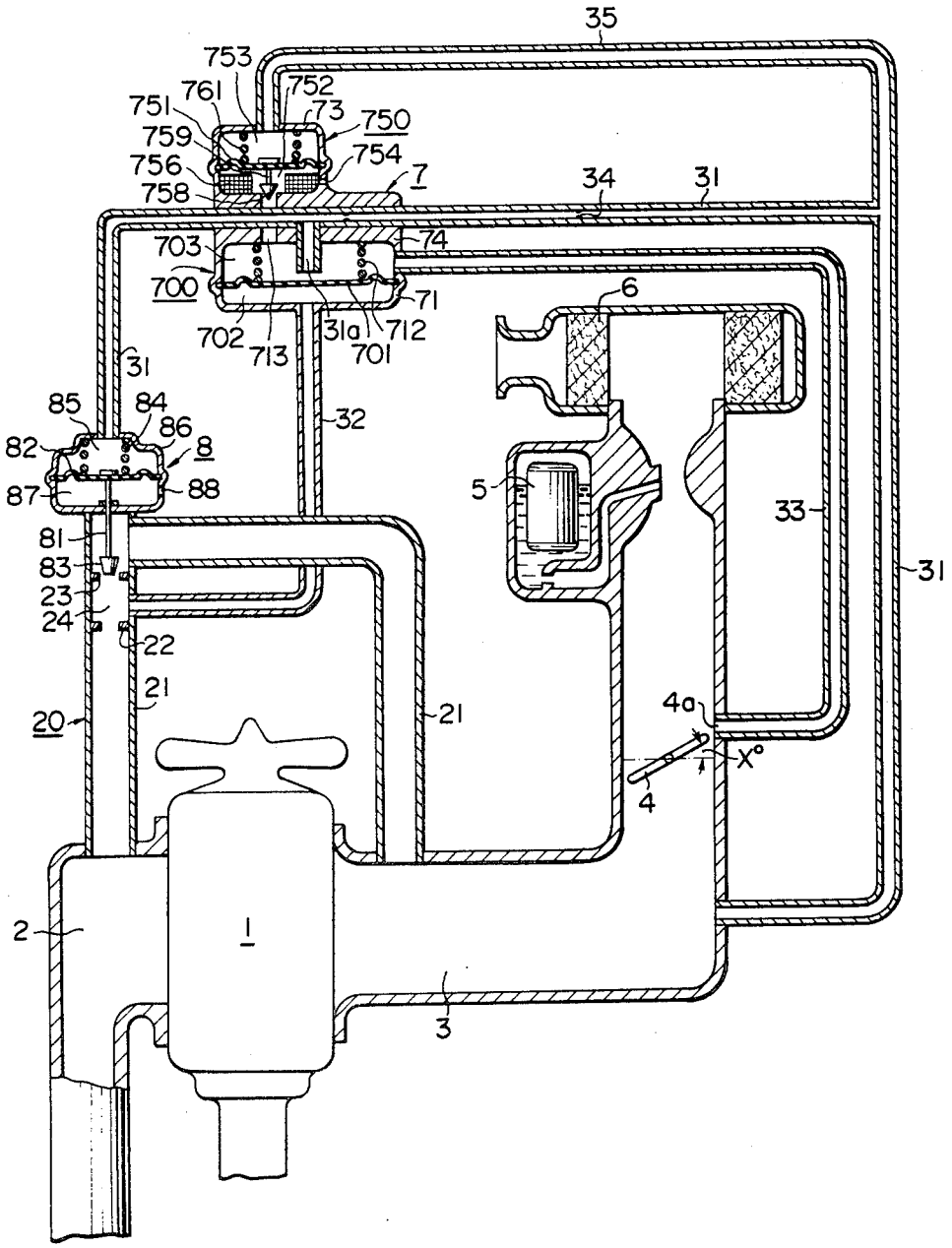

Next, description will be made on the function of the bypass passage 780 through which the constant communication is assured between the fourth and the fifth diaphragm chambers 703 and 752. As described above, the force of the spring 761 is so selected that the control communication passage 713 is closed by the valve element 758 in the heavy load operation of the engine. For example, it is assumed that the control communication passage 713 is closed by the valve element 758 at the intake negative pressure of −200 mmHg. Then, if the bypass passage 780 were not provided as in the case of the E.G.R. system shown in FIG. 12 which was manufactured for trial in the course of developing the E.G.R. system according to the invention, the fourth diaphragm chamber 703 would be applied only with the throttle negative pressure which will decrease with a rate or slope $\theta$ as the intake negative pressure decreases after the throttle negative pressure has attained the peak value A, as illustrated in FIG. 11. Thus, the pressure in the fourth diaphragm chamber 703 would literally correspond to the throttle negative pressure at the throttle port 4a. Besides, since the pressure in the fourth diaphragm chamber 703 would be then substantially equal to the pressure in the pressure cell 24, the external E.G.R. quantity or rate would decrease in accordance with the decreasing rate of the throttle negative pressure at the throttle port 4a, as is apparent from the equation $Q_{EGR}=CA\sqrt{P_{Ex}+(-P_e)}$. However, since the decreasing rate (the gradient $\theta$ in FIG. 11) of the throttle negative pressure is different in dependence on the types of the engine 1, it becomes practically impossible to use the pressure control valve apparatus of the identical construction having no bypass passage 780 for different types of internal combustion engines.

In contrast, in the case of the pressure control valve apparatus 7 according to the invention in which the bypass passage 780 is formed between the fourth and the fifth diaphragm chambers 703 and 752, the fourth diaphragm chamber 703 is supplied with the ambient air flow from the inlet port 754 formed in the fifth diaphragm chamber 752 in addition to the throttle negative pressure from the throttle port 4a after the communication passage 713 has been closed by the valve element 758. Consequently, the decreasing rate or slope of the negative pressure in the fourth diaphragm chamber 703 relative to the intake negative pressure becomes more lenient as indicated by $\theta'$ in FIG. 11 as compared with the pressure control valve apparatus in which no bypass passage 780 is provided. It will be readily appreciated that the decreasing rate $\theta'$ of the negative pressure in the fourth diaphragm chamber 703 can be reduced as the cross-sectional flow area of the bypass passage 780 is increased, which means that the pressure control valve apparatus 7 of the identical construction or specification can be used for different types of internal combustion engines merely by adjusting the cross-sectional flow area of the bypass passage 780 in accordance with the individual associated engine.

In the exhaust gas recirculating system according to the invention, it is preferred that the cross-sectional flow area or aperture area $A_1$ of the fixed restricton 22 is selected smaller than that $A_2$ of the valve seat 23 (i.e.

$A_1 < A_2$). Then, it is possible to control the exhaust gas recirculation until the pressure $P_e$ in the pressure cell 24 has attain a significantly high level in the negative direction for the reason explained below.

The pressure $P_e$ in the pressure cell 24 is determined by the rate $Q_1$ of the recirculated exhaust gas flowing into the pressure cell 24 and the rate $Q_2$ of the exhaust gas leaving the cell 24. The flow rate $Q_1$ and $Q_2$ are expressed, respectively, as follows:

$$Q_1 = C_1 A_1 \sqrt{P_{Ex} - P_e}$$

$$Q_2 = C_2 A_2 \sqrt{|P_V| + P_e}$$

where $C_1$ and $C_2$ represent the flow coefficients of the restriction 22 and the valve seat 23, respectively, and $P_V$ represents a load value attained by the load control and corresponding approximately to the pressure level in the fourth diaphragm chamber 703. Since the flow rates $Q_1$ and $Q_2$ become eventually equal to each other, the above equations may be rewritten as follows:

$$(K_1^2 + K_2^2)P_e = K_1^2 P_{Ex} - K_2^2 |P_V|$$

where $K_1 = C_1 A_1$, and $K_2 = C_2 A_2$.

Since $C_1$ and $C_2$ are positive constants which substantially approximate to each other, $K_1 < K_2$ on the assumption that $A_1 < A_2$.

Because the exhaust gas pressure $P_{Ex}$ is a positive pressure, $K_1^2 P_{Ex}$ will become greater than $K_2^2 |P_V|$ if $A_1 > A_2$, which means that the range in which $P_e$ can be controlled in the negative direction becomes narrowed. On the other hand, when selection is made such that $A_1 < A_2$, the range in which the pressure $P_e$ in the pressure cell 24 can be controlled in the negative direction is enlarged, as will be appreciated from the mathematical analyses discussed above.

By selecting the aperture area $A_2$ of the valve seat 23 greater than the aperture $A_1$ of the fixed restriction 22, the pressure in the pressure cell 24 can be controlled until a significantly high pressure level in the negative direction has been attained. Thus, even when the throttle negative pressure at the throttle port 4a has attained a maximum or peak value in the medial load operating condition of the engine, involving a significantly high negative pressure level in the fourth diaphragm chamber 703 (e.g., in FIG. 10, the negative pressure in the fourth diaphragm chamber 703 will be equal to −120 mmHg at the intake negative pressure of −180 mmHg when the engine is operated at 2000 r.p.m.), the pressure $P_e$ in the pressure cell 24 may follow a negative pressure value which approximates to the negative pressure in the forth diaphragm chamber 703.

Figure 13:
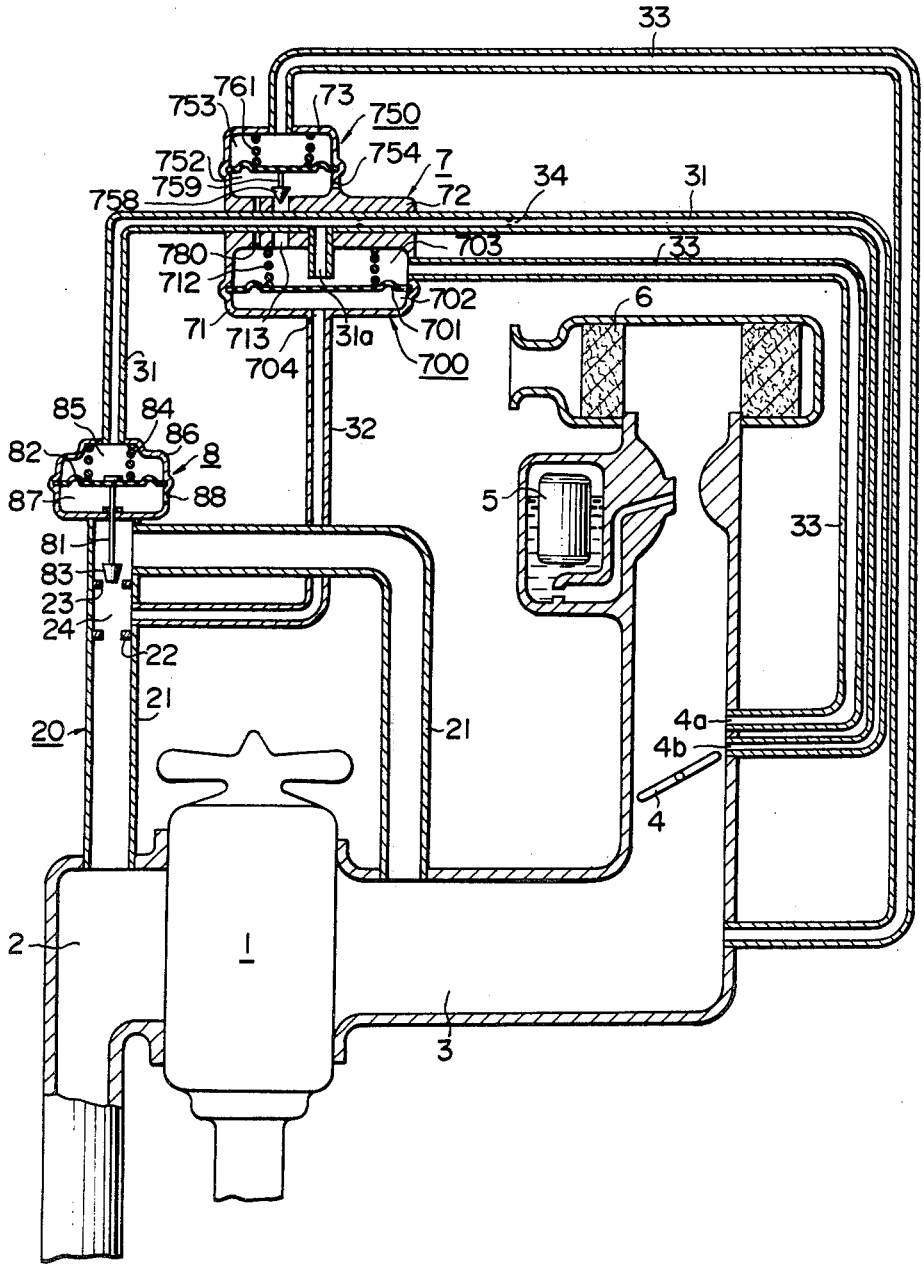
FIG. 13 shows schematically an arrangement of the E.G.R. system according to another embodiment of the invention.

FIG. 13 shows schematically a general arrangement of the exhaust gas recirculation system according to another embodiment of the invention. In the case of this E.G.R. system, the pressure signal to be applied to the control valve 8 after being subjected to the control by the modulator 7 is derived from a second throttle port 4b which is formed in the intake pipe 3 at a location upstream of the fully closed position of the throttle valve and downstream of the throttle port 4a which is communicated with the fourth diaphragm chamber 703. The throttle negative pressure supplied to the fourth diagram chamber 703 is taken from the throttle port 4a provided adjacent to and upstream of the second throttle port 4b. The negative throttle pressure produced in the second throttle port 4b is in general higher than the one produced in the first throttle port 4a and varies as a function of the engine revolution number. In the idling operation of the engine, the negative pressure in the second throttle port takes a low negative level which approximates to the atmospheric pressure (e.g. several tens mm Hg). Accordingly, in the usual operating states of the engine, the control valve 8 can be positively controlled by high negative pressures produced in the second throttle ports 4b and adjusted by the pressure control valve apparatus 7. On the other hand, in the idling operation of the engine, the throttle negative pressure applied to the control valve 8 is remarkably lowered thereby to allow the valve element 83 to close the recirculating passage 21 under the force of the spring 84.

Figure 6:
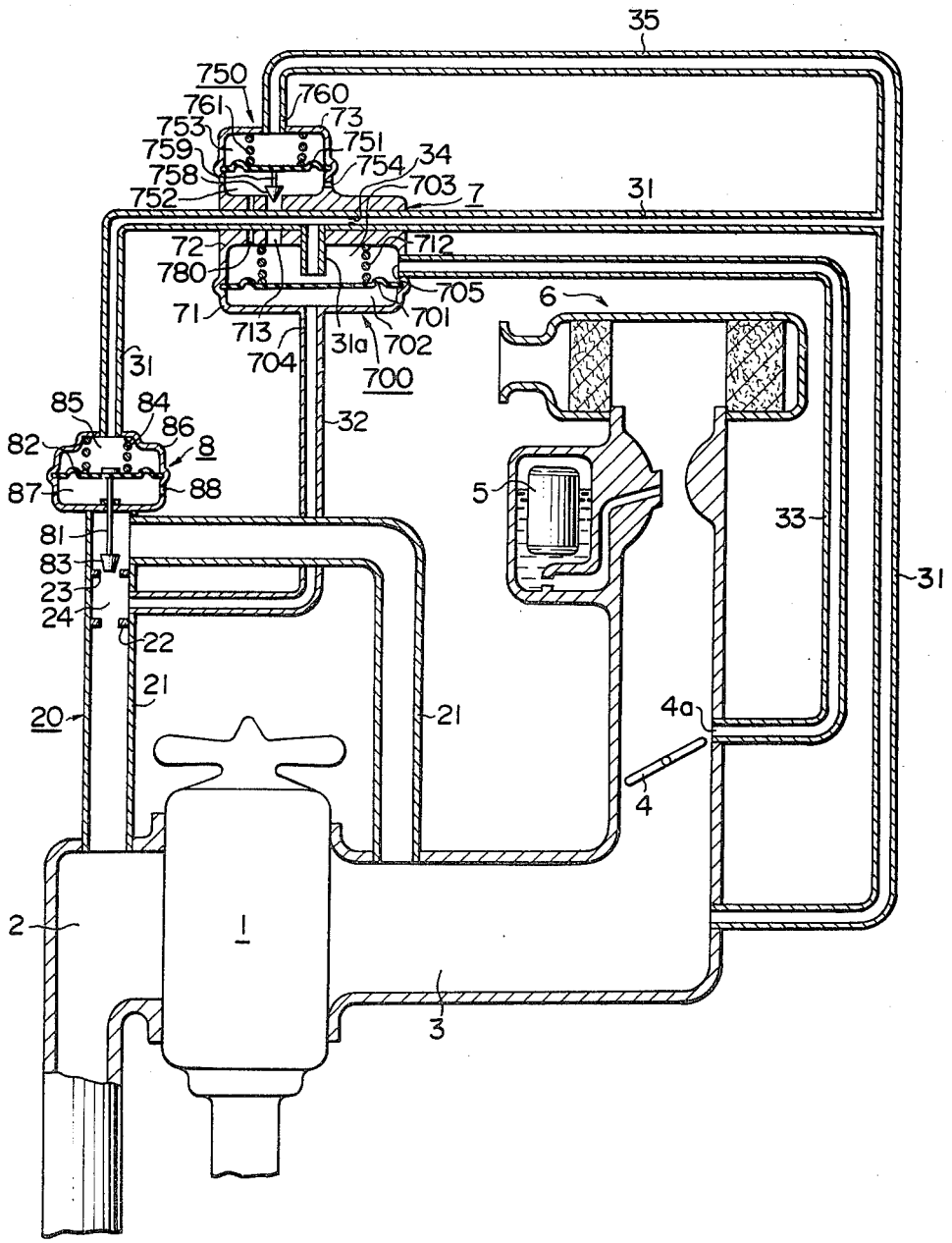
FIG. 6 shows schematically an arrangement of an E.G.R. system for an internal combustion engine according to an embodiment of the invention.
Figure 14:
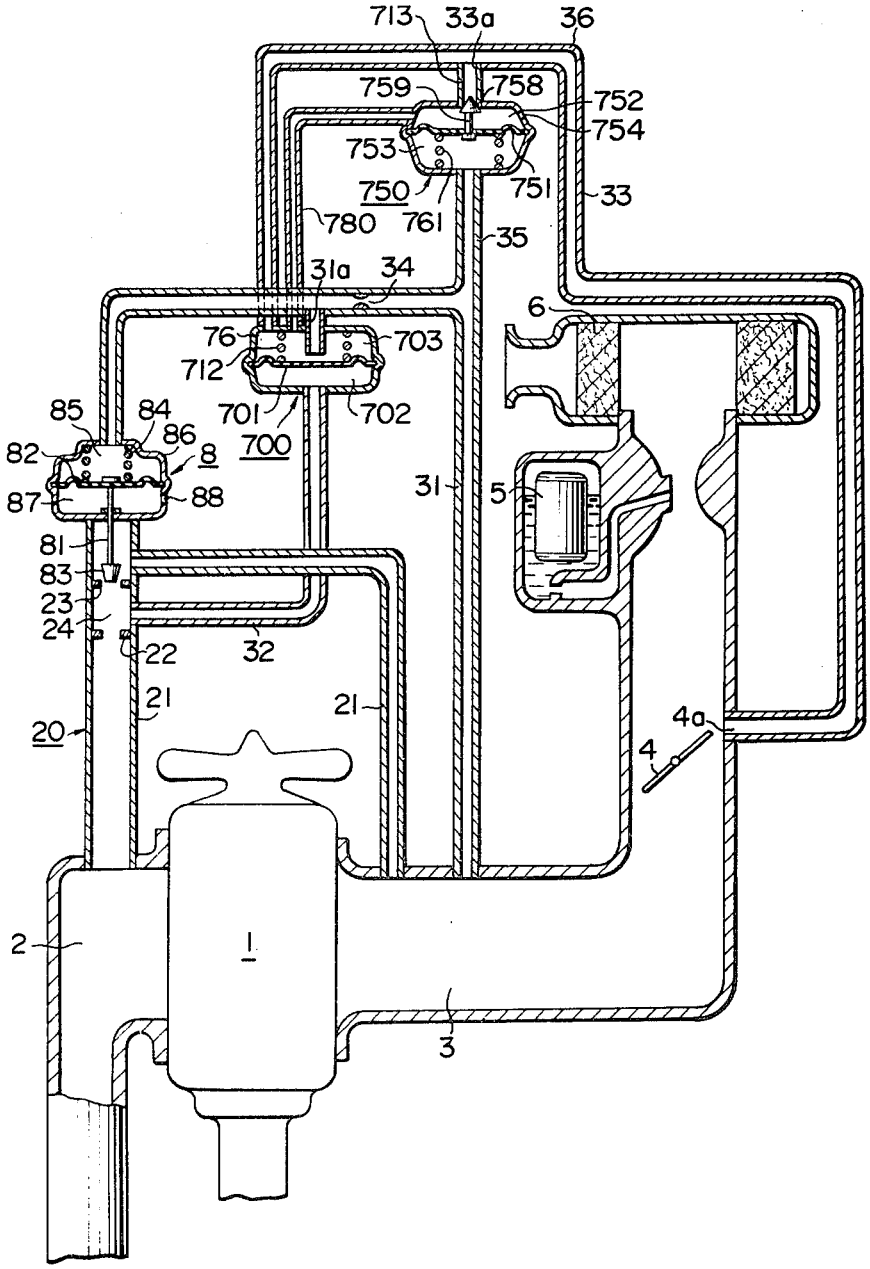
FIG. 14 shows schematically an arrangement of E.G.R. system according to still another embodiment of the invention.

FIG. 14 shows still another embodiment of the E.G.R. system according to the invention which differs from the one shown in FIG. 6 in that the pressure control unit 700 and the load control unit 750 are implemented separately instead of the integrated structure 7 shown in FIG. 6. Correspondingly, the communication passage 713 and the bypass passage 780 are individually provided instead of being formed in the housing of the pressure control valve apparatus. The communication passage 713 is connected to the third pressure conduit 33 and leads to the fourth diaphragm chamber 703. Except for these points and some corresponding modifications in the arrangement of various passages and conduits, the structure and operations of the E.G.R. system shown in FIG. 14 are similar to those of the apparatus shown in FIG. 6. Of course, the same reference numerals are used to denote the like parts.

Figure 15:
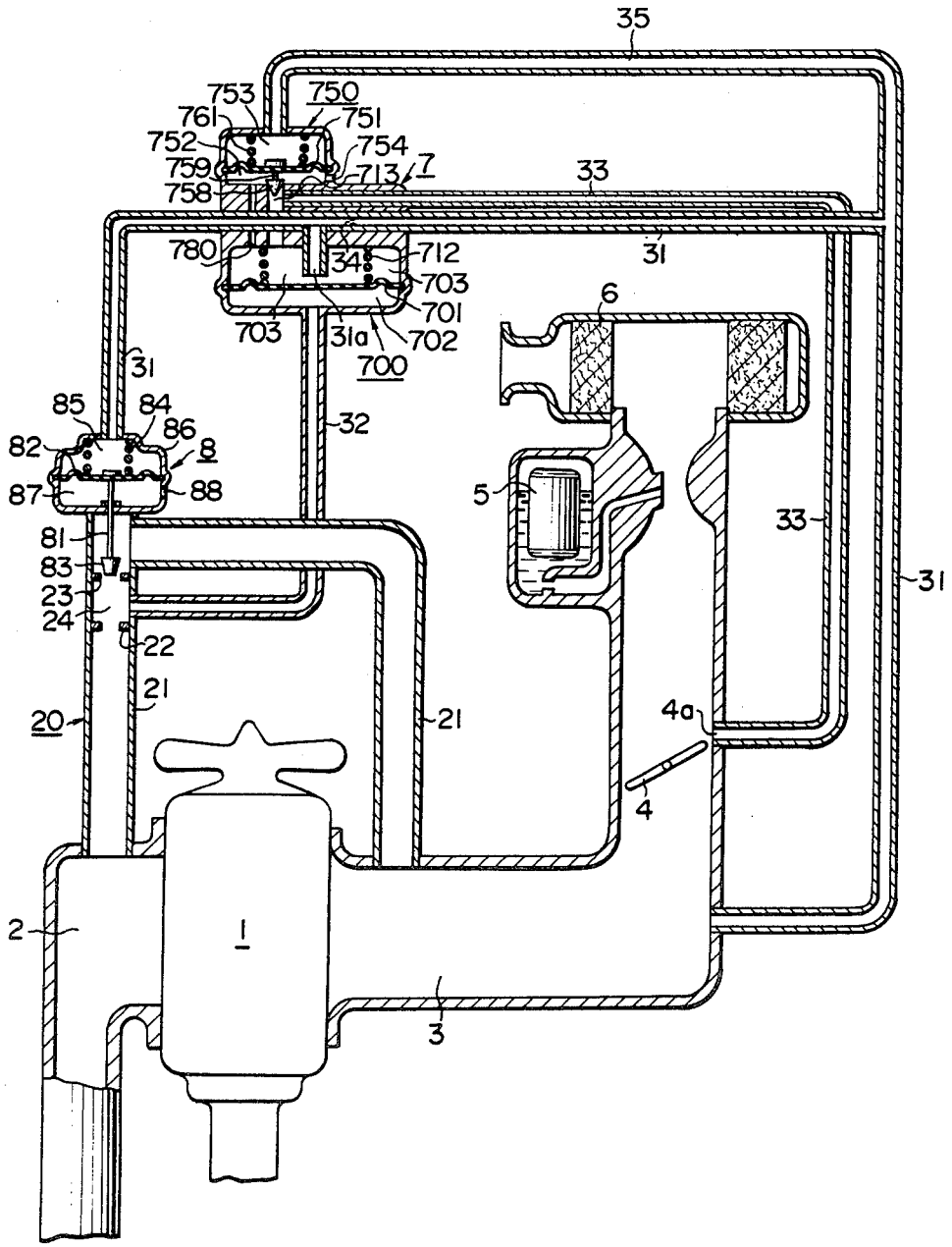

FIG. 15 shows another exemplary embodiment of the E.G.R. system according to the invention which differs from the one shown in FIG. 6 in that the throttle negative pressure at the throttle port 4a is supplied to the communication passage 713 through the third pressure conduit 33 opened in the passage 713 at a position downstream of the valve element 758. With the modified arrangement shown in FIG. 15, same operations and advantages as those of the one shown in FIG. 6 can be attained.

As will be appreciated from the foregoing description, the present invention has started from an exhaust gas recirculation system in which the E.G.R. rate or quantity is made proportional to the intake air rate or quantity by making use of the exhaust gas pressure which is substantially proportional to the intake air rate and proposed a novel and improved E.G.R. system which allows the E.G.R. rate to be additionally controlled in dependence on the load states of the internal combustion engine (i.e. E.G.R. ratio is increased in a heavy load condition of the engine and decreased in a light load operating condition), whereby the recirculation of the exhaust gas to the intake side of the engine can be controlled in an ideal manner in the usual operating load range of the engine in consideration of both the external and internal E.G.R.s, thereby to assure an effective reduction of $NO_x$ content in the exhaust gas discharged to the atmosphere.

Further, according to the invention, the correcting pressure signal for controlling the external E.G.R. rate in dependence on the engine load states is produced at the throttle port provided in the predetermined relation to the throttle valve. By virtue of this feature, the exhaust gas recirculation control is automatically effected in consideration of the engine revolution number, whereby the desirable external E.G.R. characteristics can be advantageously obtained without being subjected to adverse influences of the variation in the engine revolution number. Further, when the engine operating state is shifted to the high load condition, the external E.G.R. rate is effectively decreased to assure a high output power of the engine. The E.G.R. system according to the invention of course assures a significant reduction in fuel consumption.

We claim:

1. An exhaust gas recirculation system for internal combustion engines comprising:

a recirculating passage for tapping exhaust gas from an exhaust pipe of said engine and feeding back into an intake pipe of said engine downstream of a throttle valve provided in said intake pipe;

a control valve for controlling the exhaust gas flow through said recirculating passage in response to a pressure signal;

a pressure control valve means for controlling said pressure signal to be transmitted to said control valve;

a throttle port formed in said intake pipe at such position that said throttle port lies upstream of said throttle valve at the fully closed position thereof and lies at least partially downstream of said throttle valve when said throttle valve is opened to a predetermined opening degree; and a pressure cell provided in said recirculating passage between said exhaust gas pipe and said control valve;

said pressure control valve means including a pressure control unit for controlling said pressure signal in dependence on a throttle negative pressure produced at said throttle port and a pressure in said pressure cell, a load control unit for controlling said throttle negative pressure supplied to said pressure control unit by introducing an amount of ambient air to said pressure control unit in dependence on an intake negative pressure prevailing downstream of said throttle valve, and a bypass passage for constantly communicating a chamber of said load control unit into which said ambient air is introduced with a chamber of said pressure control unit to which said throttle negative pressure is transmitted.

2. An exhaust gas recirculation system as set forth in claim 1, wherein said throttle port is opened upstream of said throttle valve at a position falling within 11° to 35° in terms of an opening angle of said throttle valve relative to the plane containing said throttle valve at said fully closed position.

3. An exhaust gas recirculation system as set forth in claim 1 or 2, wherein said load control unit is adapted to interrupt the introduciton of said ambient air into said pressure control unit when said intake negative pressure attains a pressure value within a range of −200 mmHg to −400 mmHg.

4. An exhaust gas recirculation system as set forth in claim 1 or 2, wherein said pressure control valve means is implemented in a single structure in which said pressure control unit is integrally combined with said load control unit.

5. An exhaust gas recirculation system as set forth in claim 1 or 2, wherein said pressure control unit and said load control unit are physically separated from each other.

6. An exhaust gas recirculation system as set forth in claim 1 or 2, further including a second throttle port formed downstream of the first-mentioned throttle port at such position that said second throttle port lies upstream of said throttle valve at the fully closed position thereof and lies at least partially downstream of said throttle valve when said throttle valve is opened to a predetermined opening degree, wherein said pressure signal to be controlled by said pressure control valve means is derived from said second throttle port.

7. An exhaust gas recirculating system as set forth in claim 1 or 2, wherein said pressure cell is defined between a first fixed flow restriction and a second fixed flow restriction, said first restriction being positioned in said recirculating passage between said exhaust gas pipe and said control valve, said second restriction being positioned in said recirculating passage between said first restriction and said control valve for serving as a valve seat for a valve element of said control valve, and wherein the cross-sectional flow area of said second restriction is greater than that of said first restriction.

* * * * *